United States Patent [19]

Behr

[11] 4,073,436

[45] Feb. 14, 1978

[54] MIXING AND/OR DISPERSING AND SPRAYING ARRANGEMENT

[76] Inventor: Hans Behr, Lenzhalde 82, 7000 Stuttgart, Germany

[21] Appl. No.: 679,377

[22] Filed: Apr. 22, 1976

[30] Foreign Application Priority Data

Apr. 22, 1975 Germany ..... 2517715

[51] Int. Cl.[2] ..... B05B 7/00

[52] U.S. Cl. ..... 239/8; 239/427.5; 239/428; 239/434.5

[58] Field of Search ..... 239/419.3, 422, 427.5, 239/427, 428, 433, 434, 434.5, 432, 8

[56] References Cited

U.S. PATENT DOCUMENTS

| | | | |
|---|---|---|---|
| 2,658,800 | 11/1953 | Collinson | 239/428 |
| 2,738,230 | 3/1956 | Pillard | 239/428 |
| 3,042,311 | 7/1962 | Edwards et al. | 239/419.3 X |
| 3,049,439 | 8/1962 | Coffman | 239/422 X |
| 3,408,985 | 11/1968 | Sedlacsik, Jr. | 239/15 X |
| 3,644,076 | 2/1972 | Bagge | 239/434.5 |

*Primary Examiner*—John J. Love
*Attorney, Agent, or Firm*—Craig & Antonelli

[57] ABSTRACT

An arrangement and process for mixing components of a flowable material such as pulverous compounds of a mixed paint or of a basic lacquer and hardener of a hardenable synthetic resin and for coating of a surface of an object. A separate dispersing chamber is provided for one of the components of the flowable material with the dispersing chamber communicating with a mixing chamber for mixing the component from the dispersing chamber with at least one other component of the flowable material. The material is discharged from the mixing chamber in the form of a mist or aerosol by way of a propellant fluid. The dispersion chamber and the mixing chamber are spaced from one another and are defined between a number of elements arranged so as to form a spraying and/or dispersing nozzle.

46 Claims, 5 Drawing Figures

MIXING AND/OR DISPERSING AND SPRAYING ARRANGEMENT

The present invention relates to a spraying arrangement and, more particularly, to a mixing and/or dispersing and spraying arrangement for applying a flowable material formed of a number of individual components with the individual components being lead to a mixing chamber and with at least one dispersion chamber being provided for one of the components of the flowable material, which dispersion chamber communicates with the mixing chamber whereby the flowable material is discharged from the mixing chamber as an aerosol or mist through a nozzle by way of a propellant gas.

It has been proposed to more or less thoroughly mix components of a fluid material with one of the materials acting as a dispersant, for example, as a dispersion agent, so that there is a resulting coarse to fine dispersion by use of a static mixer having no moving parts. For coating, in accordance with the proposed solution, the fluid material thus prepared is lead to a nozzle from which it is evenly sprayed by way of compressed air as a propellant, thereby coating some object with the fluid material. One disadvantage of this proposed arranged lies in the fact that the attained degree of dispersion is not always high enough to meet the quality specifications, particularly when, depending on the type of material, dispersibility in direct mixing is slight. A further disadvantage lies in the fact that the distance between the mixer and the nozzle in the proposed solution is such that, after a change of material or even a change of only one of the components of the material, the mixer itself and the connecting conduit to the nozzle have to be flushed so that there is not only a loss of material, but also an unnecessary expenditure of labor which moreover involves interruption of the operation of the apparatus.

An apparatus for mixing components has been proposed, for example, in Offenlegungsschrift No. 2,422,868, whereby the components of a multi-component material are taken separately to nozzles that are assigned to the respective components. In such construction, the mixing of the components occurs shortly before the coating of an object in the space between the object and the respective nozzles. In such construction, the components are already sprayed and mixed externally. One drawback of this arrangement resides in the fact that the mixing is of a poorer quality than the aforementioned static mixer. Moreover, by virtue of the presence of a plurality of nozzles at the forward end of a spray gun, the proposed construction is heavy and somewhat difficult to handle.

The aim underlying the present invention essentially resides in providing a method and apparatus for mixing and/or dispersing and spraying components which produces a heretofore unattained degree of dispersion. For this purpose, at least one mixing chamber and at least one dispersion chamber is provided for at least one of the components so that the components of the coating material (dispersant) are dispersed by means of a gaseous dispersing medium, for example, compressed air, and mixed by a dispersant or dispersing medium which is introduced into the mixing chamber at a high pressure with the dispersant at the same time being utilized as a propellant gas.

According to the method of the present invention, at least one of the components of the flowable material is dispersed in a special dispersing chamber prior to reaching the other components in the mixing chamber which are only dispersed to such mixing chamber. For this purpose, in accordance with the present invention, the at least one chamber that is purely for dispersion is spacially separated from the mixing chamber; therefore, the dispersion chamber is not identical with the mixing chamber.

According to a further advantageous feature of the present invention, for mixing and dispersing two components, particularly a basic lacquer and a hardening agent, only the main component, especially the basic lacquer, is dispersed in a special dispersion chamber and, therefore, a chamber intended solely for dispersion is provided only for the main component.

According to a further feature of the present invention, at least the mixing chamber is disposed in a nozzle whereby a flushing of the mixing chamber is easily obtained. By virtue of this feature, with a change of composition of the coating material of one and the same components, only the short section between the mixing chamber and the nozzle need be flushed.

Advantageously, in accordance with the present invention, all chambers are constituted by nozzle elements whereby the entire apparatus then consists, practically speaking, of only the nozzle which has a normal size and weight. In a change of the coating material with reference to the individual components or all of the components, the material previously applied for coating, or one or more of its components, can be simply flushed out of the nozzle in a relatively short period of time without any significant losses whereby a high operating efficiency is realized.

The nozzle construction in accordance with the present invention includes a nozzle stock or holder of a stepped configuration which provides a plurality of shoulders having external threads thereon for engaging corresponding internal threads provided on at least a nozzle jacket and a nozzle cap with the nozzle stock or holder, nozzle jacket and nozzle cap essentially defining an annular dispersion chamber that opens with an axial and/or radial opening toward the outside by way of an annular gap formed between the nozzle cap and the nozzle jacket. A plurality of bores are provided in the nozzle holder for directing a supply of the dispersum and dispersing medium to the annular dispersion chamber with one annular passage for the dispersum and the dispersant, respectively, opening into a single dispersion and mixing chamber. The annular passage is communicated with associated bores and, preferably, the whole dispersum or its components and the dispersant flow in a cone-shaped discharge out of the dispersing chamber and converge in the dispersion and mixing chamber.

According to yet another feature of the present invention, the nozzle may be fashioned as a round-jet nozzle or a flat-jet nozzle which include an essentially circular-cylindrical first sleeve secured to a shoulder of the nozzle stock or holder with the sleeve defining a boundary of the dispersion and mixing chamber and forming with the nozzle holder a circular-cylindrical section of two annular passages. By virtue of the sleeve mounted at the nozzle holder, a separate delivery of the disperum and the dispersant is realized in a simple and efficient manner.

With a two-component dispersum, a second sleeve is secured at a shoulder of the nozzle stock or holder so as to form separate annular passages for the respective components of the dispersum. Advantageously, in accordance with the present invention, the second sleeve has a circular-cylindrical or circular-conical cross-sectional configuration and is arranged between the first sleeve, on the one hand, and the nozzle stock or holder and nozzle cap, on the other.

According to a further advantageous feature of the present invention, under special operating conditions, at least one of the annular passages opening into the dispersion and mixing chamber is fashioned as a Laval nozzle.

Accordingly, it is an object of the present invention to provide an arrangement and process for mixing and/or dispersing and spraying a material which avoids, by simple means, the afore-mentioned disadvantages and drawbacks encountered in the prior art.

A further object of the present invention resides in providing an arrangement and process for mixing and/or dispersing and spraying a material by which it is possible to achieve a uniform high degree of dispersion.

Another object of the present invention resides in providing an arrangement and process for mixing and/or dispersing and spraying a material whereby the flushing and/or cleaning of the components is facilitated thereby permitting a rapid changing of the compositions of the elements being dispersed and sprayed.

Yet another object of the present invention resides in providing an arrangement for mixing and/or spraying and dispensing a material which is simple to manufacture and which includes component elements which may readily be installed and removed without any difficulties.

These and other objects, features and advantages of the present invention will become more apparent from the following description when taken in connection with the accompanying drawing which shows, for the purposes of illustration only, several embodiments in accordance with the present invention, and wherein.

Figure 1:
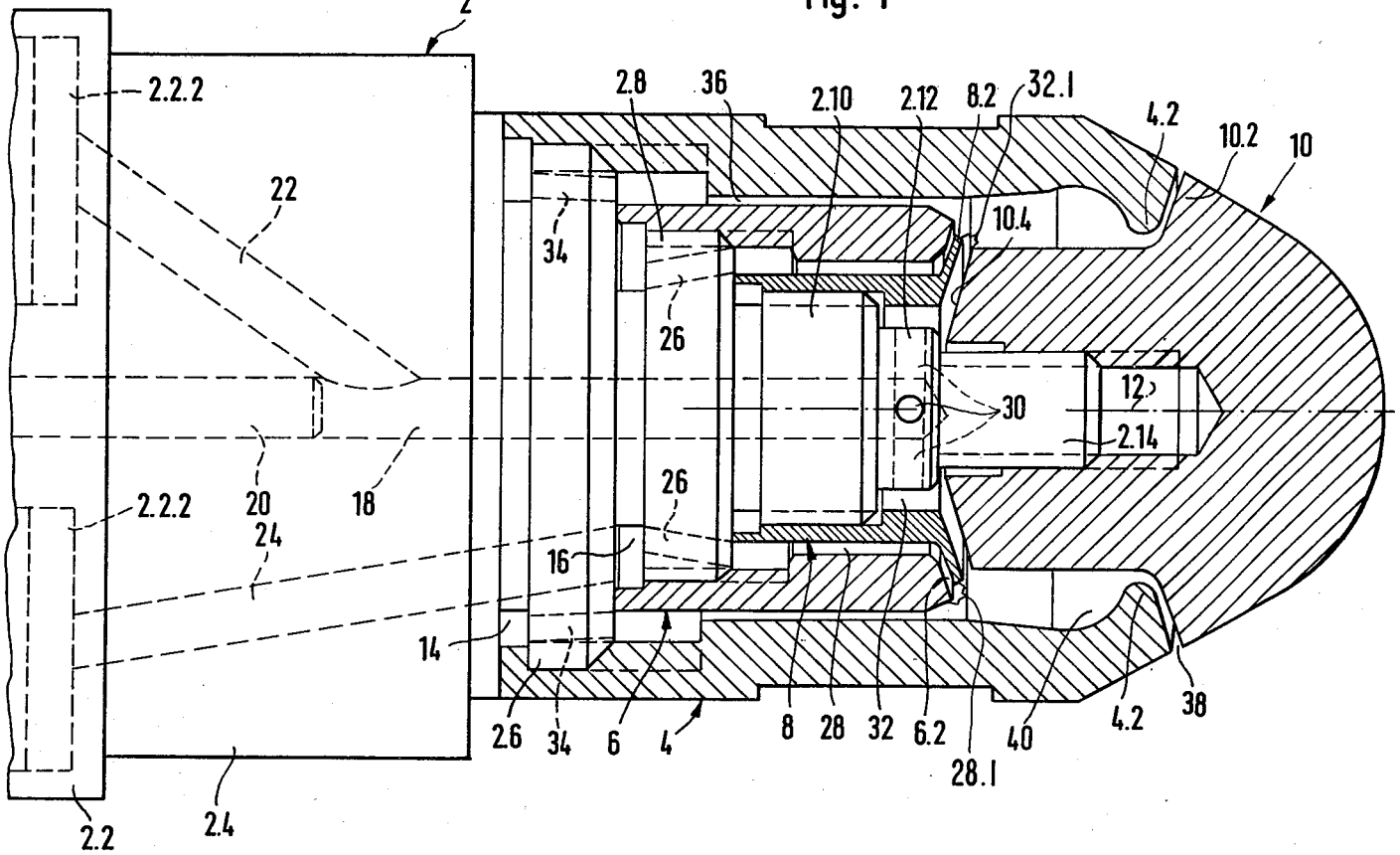
FIG. 1 is a partial cross-sectional longitudinal view of a round-jet nozzle construction in accordance with the present invention.
Figure 2:
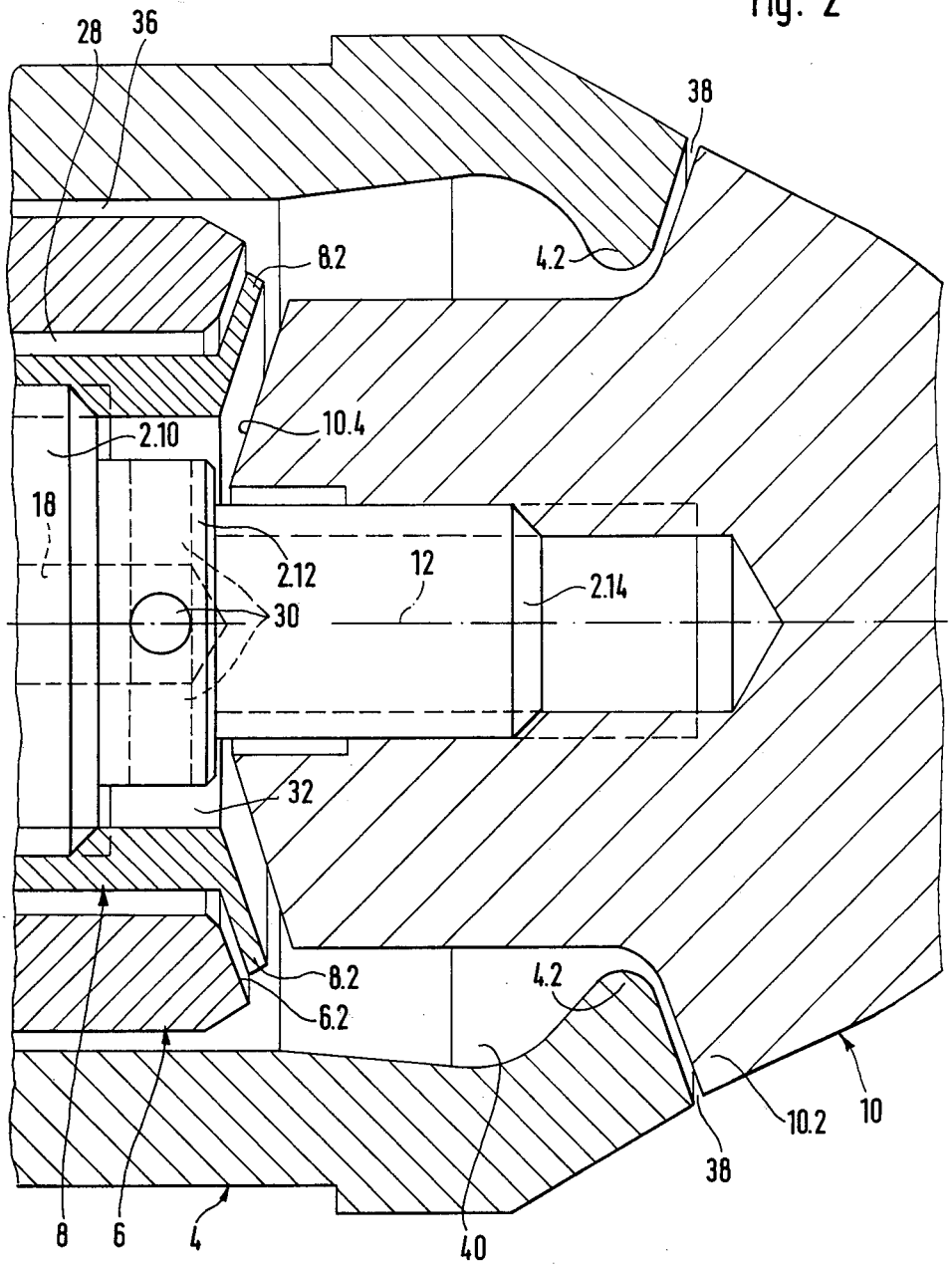
FIG. 2 is an enlarged view of a portion of the front end of the nozzle construction of FIG. 1.

Referring now to the drawings, wherein like reference numerals are used throughout the various views to designate like parts, and more particularly to FIGS. 1 and 2, according to these figures, a round-jet nozzle is provided for dispersing, for example, a lacquer consisting of two components, namely, a basic lacquer and a hardener, with the round-jet nozzle including a nozzle stock or holder 2, a large diameter nozzle jacket 4, a first sheath or sleeve 6 of a medium diameter, a second sheath or sleeve 8 of a small diameter, and a nozzle cap 10. Preferably, the jacket 4, sleeves 6, 8 and nozzle cap 10 are produced essentially as turned brass pieces and are disposed concentrically with respect to the nozzle axis 12.

As shown most clearly in FIG. 1, the nozzle holder 2 is stepped or sectioned so as to define a connecting or fastening flange 2.2 having the largest external diameter, a main part or section 2.4, an attachment stage or shoulder 2.6 for mounting the nozzle jacket 4, an attachment stage or shoulder 2.8 for mounting the first sleeve 6, an attachment stage or shoulder 2.10 for mounting the second sleeve 8, a supply section 2.12 and an extension or fixing pin 2.14 having the smallest external diameter for mounting nozzle cap 10. Between shoulder 2.6 and main section 2.4, as well as between shoulders 2.6 and 2.8, annular grooves 14, 16 are defined. All three attachment shoulders 2.6, 2.8, and 2.10, as well as the extension 2.14, are provided with an external thread which engages a corresponding internal thread provided on nozzle jacket 4, first shoulder 6, second shoulder 8 and nozzle cap 10, respectively.

An axially extending blind bore 18 is arranged in the nozzle holder 2 and terminates at the pin 2.14 with the bore 18 being closed at one end by a blind plug 20. Two diametrically opposed circular-cylindrical depressions or cavities 2.2.2 are provided on a surface of the connecting flange 2.2 which faces away from the nozzle cap 10. A first main bore 22 communicates with one of the cavities 2.2.2 and extends therefrom at an inclination to the blind bore 18, thereby communicating the cavity 2.2.2 with the blind bore 18 at a position upstream of the plug 20. A second main bore 24 communicates with the other cavity 2.2.2 and extends therefrom, at an inclination to the nozzle axis 12, to an annular chamber formed by an annular groove 16 and the first sleeve 6, thereby communicating the annular chamber with the cavity 2.2.2.

The annular chamber formed by the groove 16 and sleeve 6 communicate by way of a plurality of bores 26, evenly distributed about the periphery with a first annular passage formed by the two sleeves 6, 8 with the bores 26 extending outwardly at an oblique angle with respect to the nozzle axis 12. A plurality of radially extending bores 30 are evenly distributed about the periphery of the supply section 2.12 and communicate the blind bore 18 with a second annular chamber 32 formed between the supply section 2.12 and the second sleeve 8.

In addition to the depressions or cavities 2.2.2, the connecting flange 2.2 and the main section 2.4 are provided with a plurality of axially extending parallel bores (not shown) which communicate with an annular chamber formed between the annular groove 14 and nozzle jacket 4 with a plurality of bores 34 communicating such annular chamber with a third annular channel 36 formed by the nozzle jacket 4 and first sleeve 6. The bores 34 are preferably skewed or inclined with respect to the nozzle axis 12.

The nozzle jacket 4 is provided at its forward end with an inwardly projecting annular lip 4.2 which, together with an outer shoulder 10.2 of nozzle cap 10, forms a primarily radially but also axially extending annular discharge gap or groove 38.

The front end surface of nozzle cap 10 is rounded off with a rear end surface of the nozzle cap 10 defining a circular-conical surface 10.4 which, with a circular-conical forwardly diverging section 8.2 at a front end of the second sleeve 8, forms the forward section of the second annular chamber 32 as shown most clearly in FIG. 2. The forward section 8.2 of the second sleeve 8, together with the circular-conical surface 6.2 of first sleeve 6, forms a forward or front section of the first annular passage 28.

The nozzle jacket 4, annular lip 4.2, first sleeve 6, forward section 8.2 of second sleeve 8, and nozzle cap 10 define an annular axially extending dispersion and mixing chamber 40 which opens to the outside by way of the annular discharge gap or groove 38.

In use, a dispersing medium or dispersant agent, for example, compressed air, is delivered to the dispersion and mixing chamber 40 by way of the third annular passage 36. The two components to be dispersed are directed from a source (not shown) to cavities 2.2.2 with one of the components being fed by way of bores 22, 18, 30 to the annular chamber 32. The other component is fed from the other cavity 2.2.2 through bores 24, 26 to annular chamber 28. The two components are fed from the chambers 28, 32 through approximately radially extending discharge passages 28.1, 32.1 to the chamber 40 wherein the compressed air atomizes and mixes the two components in the mixing and dispersion chamber 40 due to the circular flow cones defined by the material flowing from the chambers 28, 32, and annular passage 36 into the chamber 40. The atomized or mist form of the mixed components is then discharged from the dispersion and mixing chamber 40 through annular discharge gap or groove 38 essentially in a radial direction.

Figure 3:
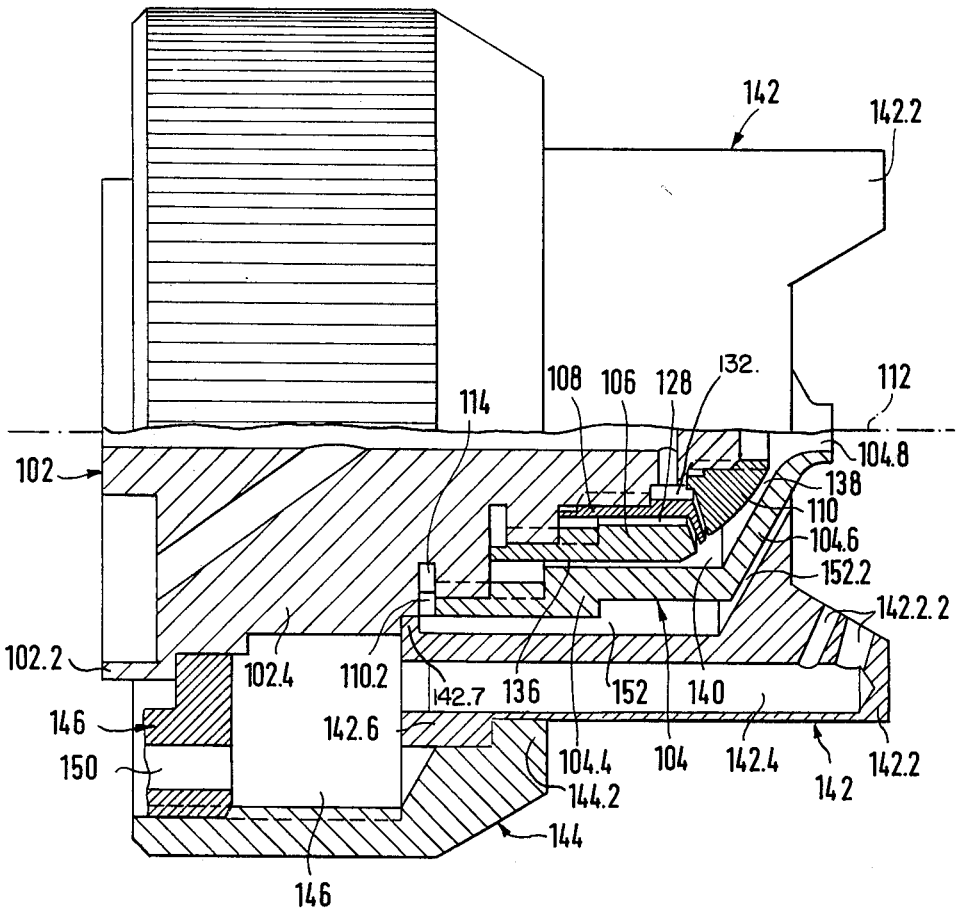
FIG. 3 is a partial cross-sectional longitudinal view of a flat-jet nozzle construction in accordance with the present invention.
Figure 4:
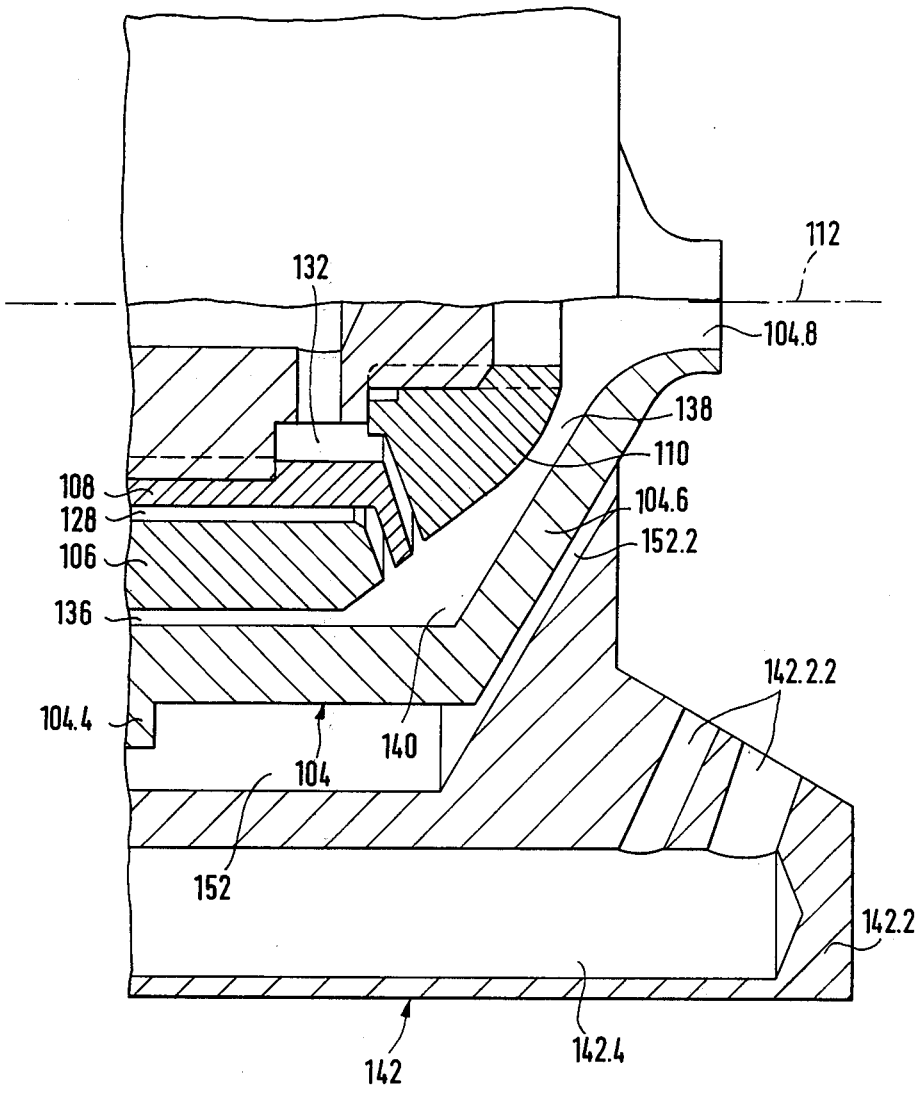
FIG. 4 is an enlarged view of a portion of the front end of the nozzle construction of FIG. 3.

As shown in FIGS. 3 and 4, a flat-jet nozzle is provided which includes a nozzle stock 102, a nozzle jacket 104, a first sheath or sleeve 106, a second sheath or sleeve 108, and a nozzle cap 110. An air cap 142 of light metal, for example, aluminum, an attaching ring 144 made preferably of a thermoplastic material and shaped like a box nut, and a connecting part 146 are provided and arranged at a connecting flange 102.2 of nozzle stock or holder 102 at which the attaching ring 144 is secured.

The nozzle stock or holder 102, nozzle jacket 104, and the two sheaths 106, 108 correspond exactly to the nozzle holder 2, nozzle jacket 4, and sleeves 6, 8 of the construction of FIGS. 1 and 2 and, to this extent, a reference is made to the above-noted description of these elements in connection with FIGS. 1 and 2.

The nozzle jacket 104 includes a circular-cylindrical section 104.4 and a forward essentially circular-conical section 104.6 which extends over or covers nozzle cap 110 with the section 104.6 having a circular axially extending discharge opening 104.8 from which the mist or atomized material issues in the direction of the nozzle axis 112.

The nozzle cap 110 is substantially smaller than the cap 10 of the construction of FIGS. 1 and 2 and, since the cap 110 is covered by the nozzle jacket 104, a forwardly converging circular-conical annular gap 138 is defined ahead of the nozzle cap 110 with the annular gap 138 communicating with the discharge opening 104.8.

The air cap 142 includes diametrically opposed tips or extensions 142.2 at a front end thereof, which extensions project forwardly of the front end of the nozzle jacket 104. Two bores 142.2.2 are provided at each extension 142.2 with the axis or line or symmetry of the bores 142.2.2 intersecting the axis 112 of the nozzle substantially at the same point along such axis. The bores 142.2.2 communicate with a blind bore 142.4 which extends parallel to the axis 112 of the nozzle. Blind bore 142.4 communicates with an annular chamber 148 formed by main section 102.4 of nozzle stock 102, attaching ring 144 and connecting member 146. The chamber 148 is supplied with a dispersant, for example, compressed air, by way of bore 150 arranged in the connecting member 146. The compressed air flows from the bores 142.4 through the bores 142.2.2 and serves to spread the flow of the mist or atomized material issuing from the opening 104.8 in a fanwise manner in a plane which is determined by the positioning of the extensions 142.2 and bores 142.2.2 with respect to the nozzle axis 112.

The air cap 142 includes an outer flange 142.6 which engages with an inner flange 144.2 formed on attaching ring 144. Preferably, the outer flange 142.6 is provided with a threaded portion which engages a corresponding external thread provided on ring 144. The air cap 142 also includes a further flange portion 142.7 which abuts or bears against an end shoulder of the main section 102.4 of the nozzle holder 102.

As shown most clearly in FIG. 4, a fourth annular passage or chamber 152 is defined between the air cap 142 and nozzle jacket 104, which chamber 152 communicates by way of a plurality of rectangular recesses 110.2, regularly distributed on the periphery of the rear edge of jacket 104, with the annular chamber formed by annular groove 114 and jacket 104. The annular chamber 152 terminates, in the region of the opening 104.8, with a second converging circular gap 152.2 which is defined between the section 104.6 of the jacket 104 and a portion of the air cap 142. The gap 152.2 creates a superficial cleansing air flow for the exterior projecting wall of the opening 104.8.

As with the construction of FIGS. 1 and 2, the annular passages 128, 132 and 136 formed by the nozzle jacket 104, sleeves 106, 108, and nozzle cap 110 provide a cone-shaped discharge into a dispersion and mixing chamber 140 whereat the components and dispersion medium are intermixed in the manner described hereinabove in connection with FIGS. 1 and 2.

Figure 5:
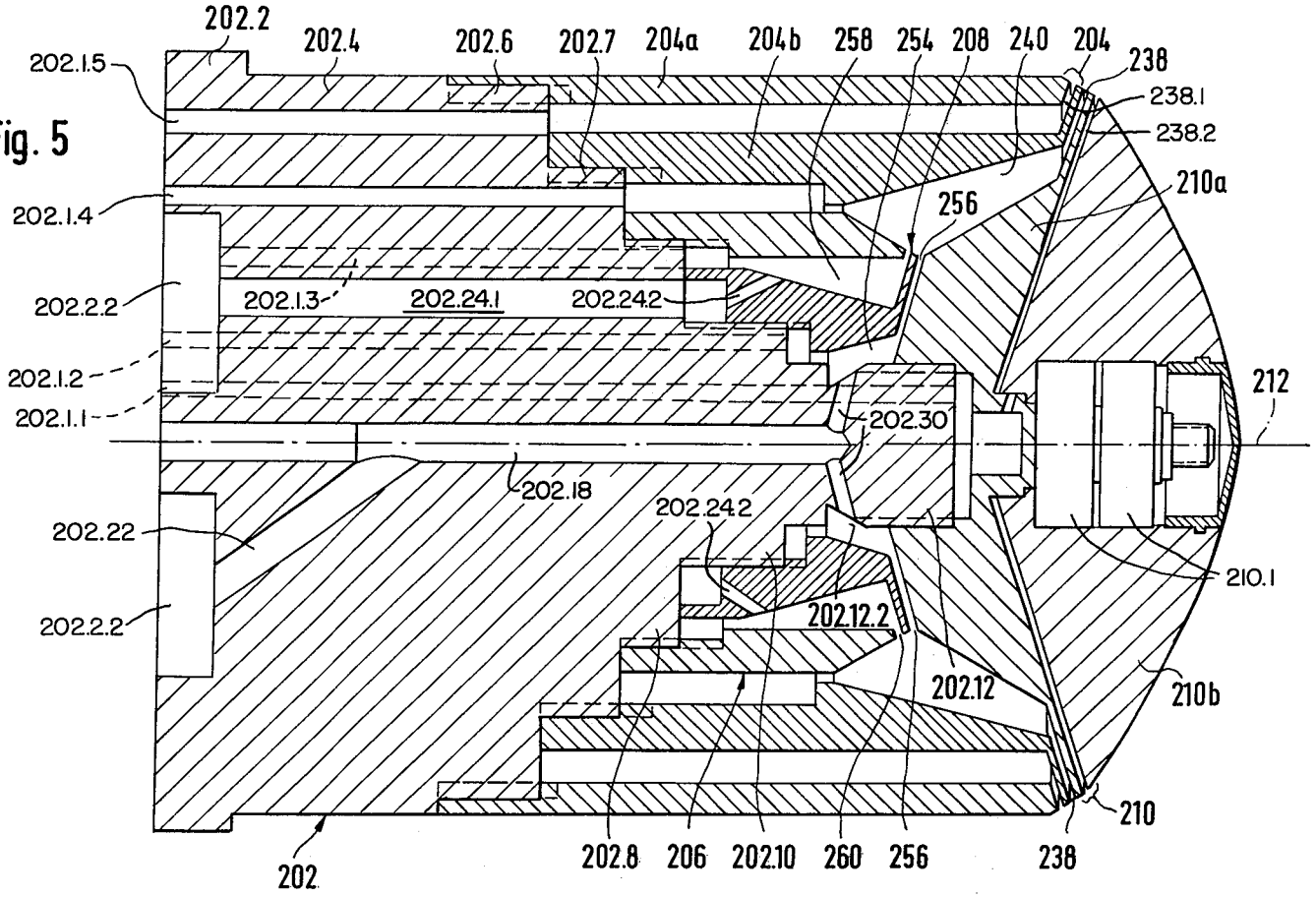
FIG. 5 is a longitudinal cross-sectional view through a further round-jet nozzle construction in accordance with the present invention.

According to FIG. 5, a round-jet nozzle is provided, similar in construction to FIGS. 1 and 2, and includes a nozzle stock or holder 202, a bi partite nozzle jacket 204, a first sheath or sleeve 206, a second sheath or sleeve 208, and a bi partite nozzle cap 210.

Nozzle stock or holder 202 includes a connecting flange 202.2, a main section or part 202.4, an attachment stage or shoulder 202.6 for mounting an external part or section **204*a* of the nozzle jacket 204, an attachment shoulder or stage 202.8 for mounting the first sleeve 206, an attachment shoulder 202.10 for mounting the second sleeve 208, and a supply or attachment extension 202.12 for mounting of a stationary section 210*a* of nozzle cap 210 and supplying material to the nozzle discharge. In the area of the shoulder or stage 202.10 and extension 202.12, there are arranged, as viewed radially from the inside toward the outside, the second sleeve 208, first sleeve 206, an inner section 204*b* of the nozzle jacket 204, and the outer section 204*a* of the nozzle jacket 204. Viewed in the direction of the nozzle axis 212, a fixed part or section 210*a* of the nozzle cap 210 is arranged behind a rotatable section 210*b* disposed on bearing assemblies 210.1**.

The significance of the bi partite construction of the nozzle jacket 204 and nozzle cap 210, as well as the design thereof, is set forth in commonly assigned United States application Ser. No. 124,612 and United States application Ser. No. 679,229, filed on even date herewith, and entitled "Nozzle Construction", the disclosures of which are incorporated herein to the extent necessary in understanding the present invention.

The inner section **204*b* of the nozzle jacket 204, first sleeve 206 and stationary section 210*a* of the nozzle cap 210 form an annular mixing and dispersion chamber 240 that opens to the outside of the nozzle by way of a forwardly diverging annular gap 238 so as to provide a discharge having a cone-shaped configuration. The supply and attachment extension 202.12 of the holder 202 is provided with an annular groove 202.12.2 having a substantially saw-toothed cross-sectional configuration. The groove 202.12.2 together with the second sleeve 208 and stationary section 210***a* of the nozzle cap 210 define a first dispersion chamber 254 for accommodating one of at least two components of the material to be dispersed or sprayed. Preferably, the annular groove 202.12.2 defines about one-third of the volume of the dispersion chamber 254.

The dispersion chamber 254 communicates with a mixing and dispersion chamber 240 by way of a forwardly directed annular passage 256 having a conical cross-sectional configuration defined by walls of the second sleeve 208 and stationary section 210*a* of the nozzle cap 210. The two sleeves 206, 208, by virtue of the configuration of the second sleeve 208, define a second dispersion chamber 258 for accommodating at least one further component of the material to be dispersed or sprayed. The second dispersion chamber 258 communicates with the mixing and dispersion chamber 240 by way of an annular opening 260 defined between the forward ends of the two sleeves 206, 208.

In the construction of FIG. 5, a dispersion medium or dispersant, for example, compressed air, is supplied to the chambers 240, 254 and 258 by way of groups of individual bores 202.1.2, 202.1.3, 202.1.4 arranged in the nozzle holder 202 with each group of bores being evenly distributed about the periphery of the holder 202. The bores 202.1.2 to 202.1.4 may extend parallel to the nozzle axis 212 or may be skewed with respect thereto.

The dispersion chambers 254, 258 are additionally supplied with one or more components of the material, for example, a coating material to be processed or applied. Suitable chambers are defined between the nozzle holder 202 and the sleeves 206, 208 which serve to deliver the dispersion medium and component materials to the dispersion chambers 254, 258 and mixing chambers 240.

In use, at least one component of the material to be dispersed or sprayed is directed from one of the cavities 202.2.2 in the flange 202.2 through axially extending bore 202.24.1 and inclined bores 202.24.2 into the dispersion chamber 258. A dispersion medium or dispersant, for example, compressed air, is fed by way of axially extending bores 202.1.3 to the chamber 258 so as to atomize or produce a mist of the material accommodated therein. At least one other component of the material to be dispersed or sprayed is fed from the other cavity or depression 202.2.2 in the flange 202.2 through inclined bore 202.22, blind bore 202.18 and substantially radially directed bores 202.30 to the dispersion chamber 254 with the dispersion medium being directed to the chamber 254 by way of the group of bores 202.1.2, whereby the material accommodated in the chamber 254 is atomized or transformed into a mist.

The components dispersed by compressed air in the two dispersion chambers 254, 258 pass into the mixing chamber 240 in the form of two cone-shaped discharges by way of annular passages 256, 260. The thus mixed components in the mixing chamber 240 are further mixed with a dispersant or dispersion medium fed by way of a group of bores 202.1.4 with the mixture then being discharged in a cone-shaped spray through annular opening 238. Thus, the mixing chamber 240 serves the purpose of thoroughly mixing the two entering mists or aerosols, depending upon the aggregate state and form of the components, from the chambers 254, 258 by means of the dispersion medium so that a maximally heterogeneous uniform mist or aerosol exits from the annular gap 238.

For the purposes of guiding the exiting mist away from the nozzle part 210*b* and jacket part 204*a*, thereby preventing a contamination or fouling thereof by way of particles adhering to the parts 210*b* and 204*a*, guidance streams are provided on each side of the discharged mist. For this purpose, the dispersion medium, for example, compressed air, is directed by way of two groups of bores 202.1.1, 202.1.5, evenly distributed about the periphery of the holder 202, to annular discharge passages 238.1, 238.2, which discharge passages provide a cone-shaped exiting of the compressed air at the area of the exiting mist or aerosol at the passage 238.

While I have shown and described several embodiments in accordance with the present invention, it is understood that the same is not limited thereto, but is susceptible of numerous changes and modifications as known to those skilled in the art, and I therefor do not wish to be limited to the details shown and described herein, but intend to cover all such changes and modifications as are encompassed by the scope of the appended claims.

I claim:

1. An arrangement for mixing and/or spraying and dispensing a multi-component fluid material through a nozzle means, the arrangement comprising:

at least one bore means arranged in the nozzle means and exclusively associated with a single component of the multi-component fluid material for directing a flow of the respective components of the multi-component fluid material in the nozzle means, annular chamber means for exclusively receiving and accommodating a single component of the multi-component fluid material, said bore means for the respective components of the multi-component fluid material terminating in a respective annular chamber means, at least one annular dispersion and mixing chamber means for receiving and accommodating the respective components of the multi-component fluid material, approximately radially extending discharge passage means for discharging the respective components from the respective annular chamber means to said dispersion and mixing chamber means, means extending axially of the nozzle means for directing a dispersing medium into the dispersion and mixing chamber means to transform the components therein into at least one of a mist and aerosol, and an essentially radial annular discharge means communicating with said dispersion and mixing chamber means for discharging the fluid material from said dispersion and mixing chamber means.

2. An arrangement according to claim 1, wherein said means for directing a dispersing medium to said at least one dispersion and mixing chamber means is an annular passage.

3. An arrangement according to claim 2, including a fluid material accommodated in said dispersion and mixing chamber means, said fluid material consisting essentially of pulverous components of a mixed paint.

4. An arrangement according to claim 2, including a material accommodated in said dispersion and mixing chamber means, said fluid material consisting essentially of a basic lacquer and a hardener of a hardenable synthetic resin.

5. An arrangement according to claim 2, wherein said at least one dispersion and mixing chamber means is disposed at a position spaced from said annular chamber means.

6. An arrangement according to claim 5, wherein the component accommodated in said annular chamber means forms a main component of the multi-component fluid material.

7. An arrangement according to claim 1, wherein at least said dispersion and mixing chamber means is accommodated in the nozzle means.

8. An arrangement according to claim 1, wherein the nozzle means includes a plurality of concentrically disposed nozzle elements, and wherein said at least one dispersion and mixing chamber means and said mixing annular chamber means are defined by said nozzle elements.

9. An arrangement according to claim 8, wherein the nozzle elements include a nozzle holder means having a stepped configuration so as to define a plurality of attaching shoulders, a nozzle jacket means mounted on one of said shoulders, a nozzle cap arranged at a forward end of said nozzle holder means, said nozzle jacket means and said nozzle cap defining at least a portion of said dispersion and mixing chamber means.

10. An arrangement according to claim 9, wherein said dispersion and mixing chamber means includes a first portion extending substantially parallel to a longitudinal axis of the nozzle means and a second portion extending substantially radially outwardly, said discharging means of said dispersion and mixing chamber means being arranged at said second portion such that a discharge therefrom is in the form of a substantially cone-shaped spray.

11. An arrangement according to claim 10, wherein said discharge means of said dispersion and mixing chamber means includes an annular gap defined between a rear surface of said nozzle cap and a forward surface of said nozzle jacket means.

12. An arrangement according to claim 10, wherein said nozzle jacket means includes an annular lip projecting inwardly toward said nozzle cap, said nozzle cap includes an outer shoulder facing said annular lip, and wherein said outer shoulder and said annular lip define an annular discharge gap for discharging the multi-component fluid material from said dispersion mixing chamber means.

13. An arrangement according to claim 11, wherein means are provided in communication with said dispersing medium directing means for feeding a dispersing medium to said dispersion and mixing chamber means whereby the multi-component fluid material is propelled through said annular discharge gap by the dispersing medium.

14. An arrangement according to claim 13, wherein said radially extending discharge passage means is fashioned such that a substantially cone-shaped discharge is directed from said annular chamber means into said dispersion and mixing chamber means.

15. An arrangement according to claim 9, wherein a nozzle sleeve means is provided and mounted at one of said plurality of attaching shoulders of said nozzle holder means at a position radially inwardly of said nozzle jacket means, said nozzle sleeve means including a radially outer wall portion defining a radially inner boundary wall of said dispersion and mixing chamber means.

16. An arrangement according to claim 15, wherein said sleeve means has a substantially circular cross-sectional configuration.

17. An arrangement according to claim 9, wherein said annular chamber means is a dispersion chamber accommodating only a single component of the multi-component fluid material, said dispersion chamber being arranged at a position spaced from said dispersion and mixing chamber means and communicating therewith by the approximately radially extending discharge passage means, and wherein means are provided for directing a supply of a dispersing medium to said dispersion chamber so as to transform the component accommodated therein into at least one of a mist and an aerosol.

18. An arrangement according to claim 8, wherein the nozzle elements include a nozzle holder means having a stepped configuration so as to define a plurality of attaching shoulders, a nozzle sleeve means mounted on one of said shoulders, a nozzle cap arranged at a forward end of said nozzle holder means, said nozzle sleeve means and a portion of said nozzle cap defining at least a portion of said dispersion and mixing chamber means.

19. An arrangement according to claim 18, wherein a further nozzle sleeve means is provided and mounted at another shoulder of said plurality of attaching shoulders of said nozzle holder means at a position radially inwardly of said first-mentioned nozzle sleeve means, said dispersion chamber being defined between a portion of a radially inner surface of said first-mentioned nozzle sleeve means and a radially outer surface of said further nozzle sleeve means.

20. An arrangement according to claim 19, wherein said first mentioned nozzle sleeve means has a substantially circular cross-sectional configuration.

21. An arrangement according to claim 19, wherein said further sleeve means includes a flanged end surface arranged opposite a portion of a rear end surface of said nozzle cap and spaced therefrom so as to form the approximately radially extending discharge passage means for discharging the component of the multi-component fluid material from said dispersion chamber into said dispersion and mixing chamber means in the form of a substantially cone-shaped spray.

22. An arrangement according to claim 21, wherein at least one of said discharge means of said dispersion and mixing chamber means and the approximately radially extending discharge passage means of said dispersion chamber is constructed as a Laval nozzle.

23. An arrangement according to claim 21, wherein said nozzle cap is of a bi-partite construction, said nozzle holder means including an axially extending portion having a first part of said nozzle cap fixedly mounted thereon, said nozzle holder means further including a supporting means arranged forwardly of said axially extending portion for mounting the second part of the nozzle cap thereon.

24. An arrangement according to claim 23, wherein means are provided for rotatably mounting the second part of said nozzle cap on said supporting means, and wherein means are provided for rotatably driving the second part of said nozzle cap.

25. An arrangement according to claim 24, wherein said means for rotatably driving includes a means for directing a supply of a dispersing medium to the second part of said nozzle cap such that the dispersing medium is directed at a rear surface of the second part so as to cause a rotation thereof.

26. An arrangement according to claim 25, wherein means are provided for generating a guiding stream for the material discharged from said mixing chamber means.

27. An arrangement according to claim 21, wherein said means for directing a dispersing medium to said at least one dispersion and mixing chamber means includes at least one bore means extending substantially parallel to a longitudinal axis of said nozzle means for communicating a dispersing medium supply with said at least one dispersion and mixing chamber means.

28. An arrangement according to claim 27, wherein said means for directing a supply of a dispersing medium to said dispersion chamber includes at least one further bore means extending substantially parallel to the longitudinal axis of the nozzle means for communicating a dispersing medium supply with said dispersion chamber.

29. An arrangement according to claim 1, wherein a nozzle holder means includes a connecting flange means, and wherein at least two diametrically opposed cavities are provided in said connecting flange means for respectively accommodating a single component of the multi-component fluid material, said cavities being in communication with respective bore means for directing a flow of the respective components from each of said cavities to respective annular chamber means.

30. An arrangement according to claim 29, wherein said bore means associated with one of the cavities includes a bore extending from said cavities at an inclination with respect to a longitudinal axis of the nozzle means, and an axially extending bore for communicating the inclined bore with one of said annular chamber means.

31. An arrangement according to claim 30, wherein said bore means associated with the other of said cavities includes an additional bore extending at an inclination to the longitudinal axis of the nozzle means, an annular groove means defined between at least a portion of a sleeve means of the nozzle means and a shoulder of a nozzle holder means, said additional bore terminating in said annular groove means, and at least one further inclined bore provided in said nozzle holder means for communicating said annular groove means with another of said annular chamber means.

32. An arrangement according to claim 30, wherein said bore means associated with the other of said cavities includes at least one axially extending bore, an annular channel means defined between a sleeve means, the nozzle means and a shoulder of a nozzle holder means, and at least one inclined bore provided in the sleeve means for communicating said annular channel means with another of said annular chamber means.

33. An arrangement according to claim 9, wherein said nozzle jacket means includes a first circular-cylindrical section and an essentially conical forward section such that said nozzle jacket means surrounds said nozzle cap, said conical forward section being spaced from a front end of said nozzle cap to define an annular gap, an axially extending substantially circular opening being provided at said conical forward section and constituting said means for discharging the multi-component fluid material from said dispersion and mixing chamber means.

34. An arrangement according to claim 33, wherein means are provided for controlling the discharge of the multi-component fluid material from said dispersion and mixing chamber means.

35. An arrangement according to claim 34, wherein said controlling means includes an air cap means mounted at a front end of said nozzle holder means including at least one bore means arranged above and below the discharging multi-component fluid material so as to fan out such discharging material.

36. An arrangement according to claim 35, wherein means are provided for creating a superficial cleaning air flow along an exterior wall of said axially extending opening.

37. An arrangement according to claim 36, wherein said last-mentioned means includes at least one annular gap having a discharge directed toward the axially extending opening.

38. An arrangement according to claim 37, wherein said at least one annular gap includes a first axially extending portion and a second radially extending portion, said radially extending portion forming said discharge directed toward the axially extending opening.

39. An arrangement according to claim 33, wherein a nozzle sleeve means is provided and mounted at one of said plurality of shoulders of said nozzle holder means at a position radially inwardly of said nozzle jacket means, said nozzle sleeve means including a radially outer wall portion defining a portion of a radially inner boundary wall of said dispersion and mixing chamber means.

40. An arrangement according to claim 1, wherein said annular chamber means is a dispersion chamber accommodating only a single component of the multi-component fluid material, said dispersion chamber being arranged at a position spaced from the dispersion and mixing chamber means and communicating therewith by the approximately radially extending discharge passage means, and wherein means are provided for directing a supply of a dispersing medium to said dispersion chamber so as to transform the component accommodated therein into at least one of a mist and an aerosol.

41. An arrangement according to claim 40, wherein the nozzle means includes a nozzle holder having a plurality of attaching shoulders, a first nozzle sleeve means mounted at one of said shoulders, and wherein a further nozzle sleeve means is mounted at another of said shoulders of said nozzle holder, said dispersion chamber being defined between a portion of a radially inner surface of said first nozzle sleeve means and a radially outer surface of said further nozzle sleeve means.

42. A method for mixing and/or spraying and dispersing a multi-component fluid material through a nozzle means, the method comprising the steps of:

feeding single components of the multi-component fluid material to individual independent annular chamber means;

feeding the components of the multi-component fluid material from the individual independent annular chamber means into a dispersion and mixing chamber means through approximately radially extending discharge passage means;

supplying a dispersing medium to said dispersion and mixing chamber means so as to atomize the material accommodated therein;

and discharging the mixture of the atomized components in the dispersion and mixing chamber means from said dispersion and mixing chamber means by way of the dispersing medium.

43. The method according to claim 42, wherein the step of discharging the single component from the annular chamber means includes discharging such material into said dispersion and mixing chamber means in the form of a substantially cone-shaped spray.

44. The method according to claim 43, further comprising the steps of feeding a further component of the multi-component fluid material into a further annular chamber means;

and discharging the component in the further annular chamber means into said dispersion and mixing chamber means along with the component from the first-mentioned annular chamber means so that the components from the annular chamber means are thoroughly mixed in the dispersion and mixing chamber means prior to discharge therefrom.

45. The method according to claim 44, further comprising the step of guiding the discharging mixture from the dispersion and mixing chamber means such that a contact between the discharging material and the nozzle means is prevented.

46. The method according to claim 44, further comprising the step of controlling the discharge from the dispersion and mixing chamber means so that such discharge is in the form of a fan-shaped spray.

* * * * *